US006402425B1

(12) United States Patent
Paladeni

(10) Patent No.: US 6,402,425 B1
(45) Date of Patent: Jun. 11, 2002

(54) POWERED ROLLER SCREED HAVING A SPLIT DRIVE TUBE

(76) Inventor: Tod Paladeni, 1418 NW. 138th Cir., Vancouver, WA (US) 98685

( * ) Notice: Subject to any disclaimer, the term of this patent is extended or adjusted under 35 U.S.C. 154(b) by 0 days.

(21) Appl. No.: 09/507,097

(22) Filed: Feb. 17, 2000

Related U.S. Application Data

(63) Continuation-in-part of application No. 09/304,616, filed on May 3, 1999, now Pat. No. 6,350,083.

(51) Int. Cl.[7] ..... E01C 19/24
(52) U.S. Cl. ..... 404/118; 404/103; 404/122
(58) Field of Search ..... 404/101, 103, 404/114, 117, 118, 119, 122, 84.1, 84.2, 131

(56) References Cited

U.S. PATENT DOCUMENTS

| | | | | | |
|---|---|---|---|---|---|
| 1,581,784 | A | * | 4/1926 | Butler | 404/103 |
| 2,133,862 | A | * | 10/1938 | Kerns | 404/117 |
| 3,383,992 | A | * | 5/1968 | Kaltenegger | 404/117 |
| 3,415,174 | A | * | 12/1968 | Kaltenegger | 404/117 |
| 3,421,420 | A | * | 1/1969 | Piatkowski | 404/117 |
| 3,422,735 | A | * | 1/1969 | Vitry | 404/117 |
| 3,431,832 | A | * | 3/1969 | Lang | 404/117 |
| 3,515,042 | A | * | 6/1970 | Austin | 404/117 |
| 3,605,582 | A | * | 9/1971 | Kaltenegger | 404/117 |
| 3,698,293 | A | * | 10/1972 | Wagner | 404/117 |
| 4,142,845 | A | | 3/1979 | Mitchell | |
| 4,614,486 | A | | 9/1986 | Bragagnini | |
| 5,261,213 | A | * | 11/1993 | Humphrey | 404/114 |
| 5,456,549 | A | | 10/1995 | Paladeni | |
| 5,562,361 | A | | 10/1996 | Allen | |
| 5,664,908 | A | | 9/1997 | Paladeni | |
| 5,803,656 | A | | 9/1998 | Turck | |

FOREIGN PATENT DOCUMENTS

| | | | | |
|---|---|---|---|---|
| AU | 400782 | * | 9/1966 | 404/122 |

OTHER PUBLICATIONS

Roller Screed, advertisement brochure, date uncertain.
J.D. Concrete Screed, Self Propelled Concrete Roller Screeds, advertisement brochure, date uncertain.

* cited by examiner

*Primary Examiner*—Thomas B. Will
*Assistant Examiner*—Alexandra K. Pechhold
(74) *Attorney, Agent, or Firm*—Ipsolon LLP

(57) ABSTRACT

A powered rotary screed provides a powered strike tube that rotates to provide a finish to wet concrete during screeding and a drive tube that provides motive power to the screed to assist with the difficult task of removing excess concrete from a poured pad, or other horizontal concrete surface. The drive tube is split to provide two separate portions that can be independently controlled for easy control of the screed as the screed works concrete. The drive tube portions are elongate cylinders that are axially aligned and rotatable relative to one another. Separate motors drive respective drive tube portions and can be individually controlled to prevent skewing of the screed.

8 Claims, 4 Drawing Sheets

POWERED ROLLER SCREED HAVING A SPLIT DRIVE TUBE

This application is a continuation-in-part of U.S. patent application Ser. No. 09/304,616, filed May 3, 1999, now U.S. Pat. No. 6,350,083.

FIELD OF THE INVENTION

The present invention pertains to the field of powered roller screeds used to screed cementitious material.

BACKGROUND OF THE RELATED ART

Concrete structures are formed by pouring a cementitious material, such as cement and aggregate (comprising concrete slurry) into a form, or other container, and permitting the material to cure under proper conditions. In the case of a. concrete pad, such as a floor, foundation, or roadway, concrete is poured onto a ground, or support, surface and contained by forms connected to, and rising above, the ground surface. The forms are longitudinal members arranged along a border of a desired location for the concrete pad to contain the viscous concrete and provide a guide for the concrete's thickness and to level the top surface of the concrete.

After concrete is poured between forms, it is spread evenly between the forms. A screed is then used to remove excess concrete and level the top surface of the concrete so it is even with the forms. Often, several passes of a screed over the concrete is necessary to achieve the desired surface. Precision is required to conform to building codes and to perform quality work.

A very primitive screed, which is still useful on small jobs, is a simple straight edge such as a straight board. The board, chosen long enough to span the forms, is laid on top of each form and thereafter worked side-to-side and pulled down the length of the forms by workers at each end of the board. This process pushes forward excess concrete: excess concrete is concrete that is higher than the top surface of the forms. While quite suitable for small jobs, such a screed is impractical on large jobs because of the work required to move the excess concrete.

A more practical screed for larger jobs is disclosed in Mitchell, U.S. Pat. No. 4,142,816. Mitchell discloses a powered screed having a hydraulic motor to spin a tubular member while the screed is pulled along the forms by two workers, one each located on either side of the forms. As with most rotary screeds, the tubular member spins in a direction opposite a direction of travel of the screed. By spinning the tube, this screed provides a good surface to the concrete. However, substantial work is required to pull the screed along the forms. The hydraulic motor, spinning the tube, does not assist to propel the screed forward and the heavy concrete that builds up in front of the screed requires a large amount of force to move. In addition, workers located at each end of the Mitchell screed must keep the screed tube substantially perpendicular to the forms—frequently this is a difficult task because of uneven amounts of concrete from side-to-side and unequal strengths of the workers.

Larger, powered screeds are suitable for large, high-volume jobs. U.S. Pat. No. 5,456,549 discloses a powered rotary screed having a modular frame that spans across concrete-retaining forms to support a strike tube and drive tubes. The frame provides rigidity and support so that the screed can span large distances between forms. The strike tube rotates opposite the direction of screed travel to screed the concrete and the drive tubes provide motive force to propel the screed.. While very useful for large jobs, and jobs that are not constrained by space limitations, these larger screeds are difficult to use in close quarters and are more difficult to transport.

Accordingly, there is a need in the industry to provide a powered screed that can be easily controlled during use, and conveniently transported and set up for use.

SUMMARY OF THE INVENTION

The present invention provides a frameless roller screed having two tubes: a strike tube and a drive tube. The strike tube is located at a leading edge of the screed and is made to rotate so as to oppose the direction of motion of the screed. The strike tube contacts rough laid concrete to level the concrete to the height of the forms and finish the surface of the concrete. The rotational motion of the. screed tube provides a better quality finish to the concrete surface than can be achieved with a non-rotating strike tube or a strike tube that rotates in the direction of travel.

In preferred embodiments, the drive tube of the present invention is a split drive tube having independently controlled portions that provide superior control of the screed during operation. The drive tube is split into first and second drive tube portions that are separately controlled by the operator so that left and right ends of the screed may be independently driven to adjust for misalignment that may occur as the screed moves along the forms. Oftentimes, uneven concrete will present uneven resistance to the screed and impede the forward progress of the screed on one side, thereby misaligning the screed on the forms. The split drive tube of the present invention permits the operator to adjust the motive power at one end of the screed relative to the other end so as to compensate for such misalignment.

In preferred embodiments, the first and second drive tube portions are cylindrical and the two portions are axially aligned and coupled. The drive tube portions are coupled so as rotate independently of each other and each portion is separately driven to permit separate control of the respective portions.

Preferably, hydraulic motors drive the strike tube and the drive tube. The strike tube is powered by a single motor for control of the rotational speed and direction of rotation of the strike tube.

The drive tube is powered by two motors. One motor controls each one of the respective two drive portions, thus allowing separate control of the first and second drive portions as to rotational speed and direction of rotation.

In addition, the screed includes handles located on opposite ends of the screed that are arranged as levers to assist with control of the screed. The handles are coupled to the screed such that an operator can push a distal end of the handle downward, or raise the distal end upward, to lever the drive tube about the strike tube. Pushing down on the handle tends to lift the drive tube off of the forms so that forward motion of the screed may be easily, and quickly, halted. Alternatively, lifting the handles places more of the screed's weight on the drive tube and increases the drive tube's pressure on the forms so that the drive tube can provide more motive force without slipping.

Using the handles as the primary means to control the screed during operation requires trained operators at each end of the screed. However, by providing the drive tube as a split drive tube, as disclosed in the present invention, allows one person control and operation of the screed.

The roller tubes of the present invention are coupled together by plates located on distal ends of the screed. The screed has no frame that extends substantially over the concrete, or spans the forms.

Accordingly, the present invention provides a frameless, powered rotary screed having a split drive tube with separately controllable ends that permit the screed operator to control the screed's motive force at, each end separately to adjust for uneven concrete and prevent skewing of the screed on the forms.

DETAILED DESCRIPTION OF THE PREFERRED EMBODIMENTS

Figure 1:
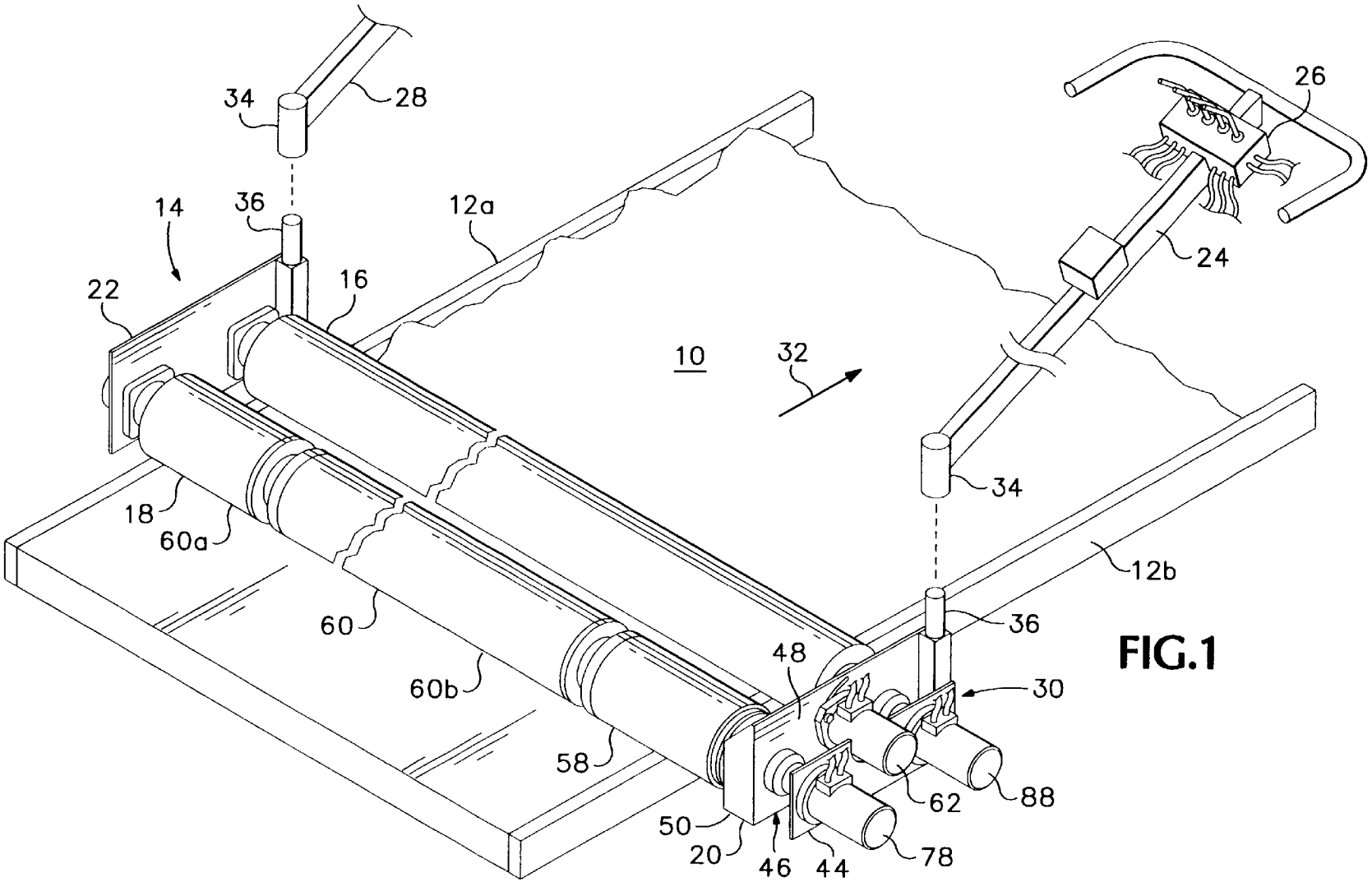
FIG. 1 is a perspective view of a preferred embodiment of a power driven roller screed of the present invention including an environment of screed forms supporting the roller screed and cementitious material located between the forms. The screed tubes are shown in broken view to represent indefinite lengths.
Figure 3:
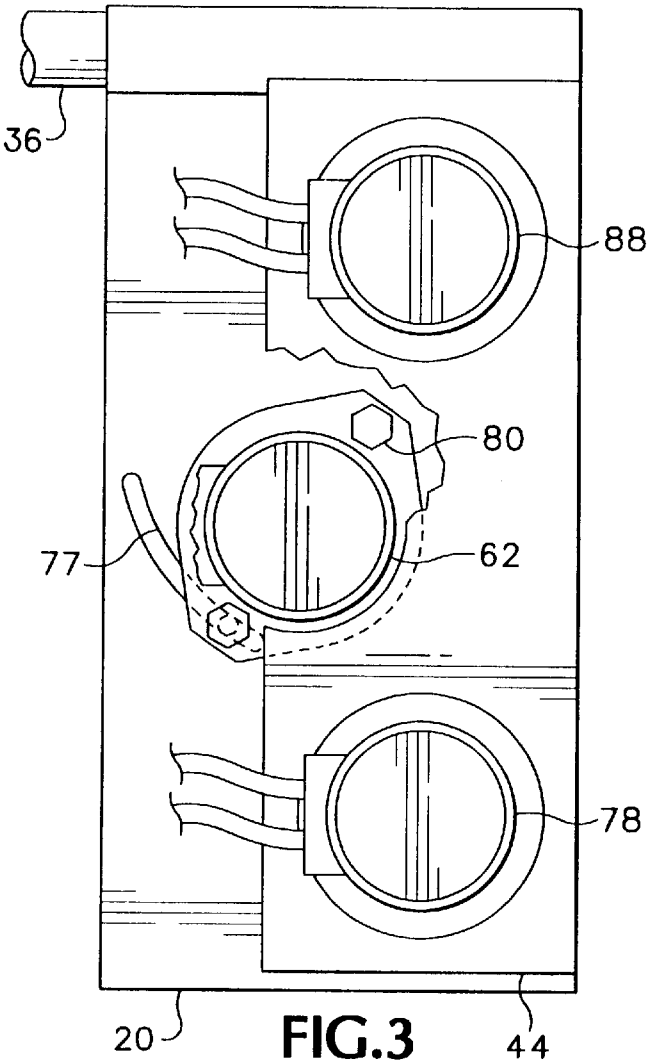
FIG. 3 is an end-view elevation of the roller screed drive end of FIG. 2.
Figure 2:
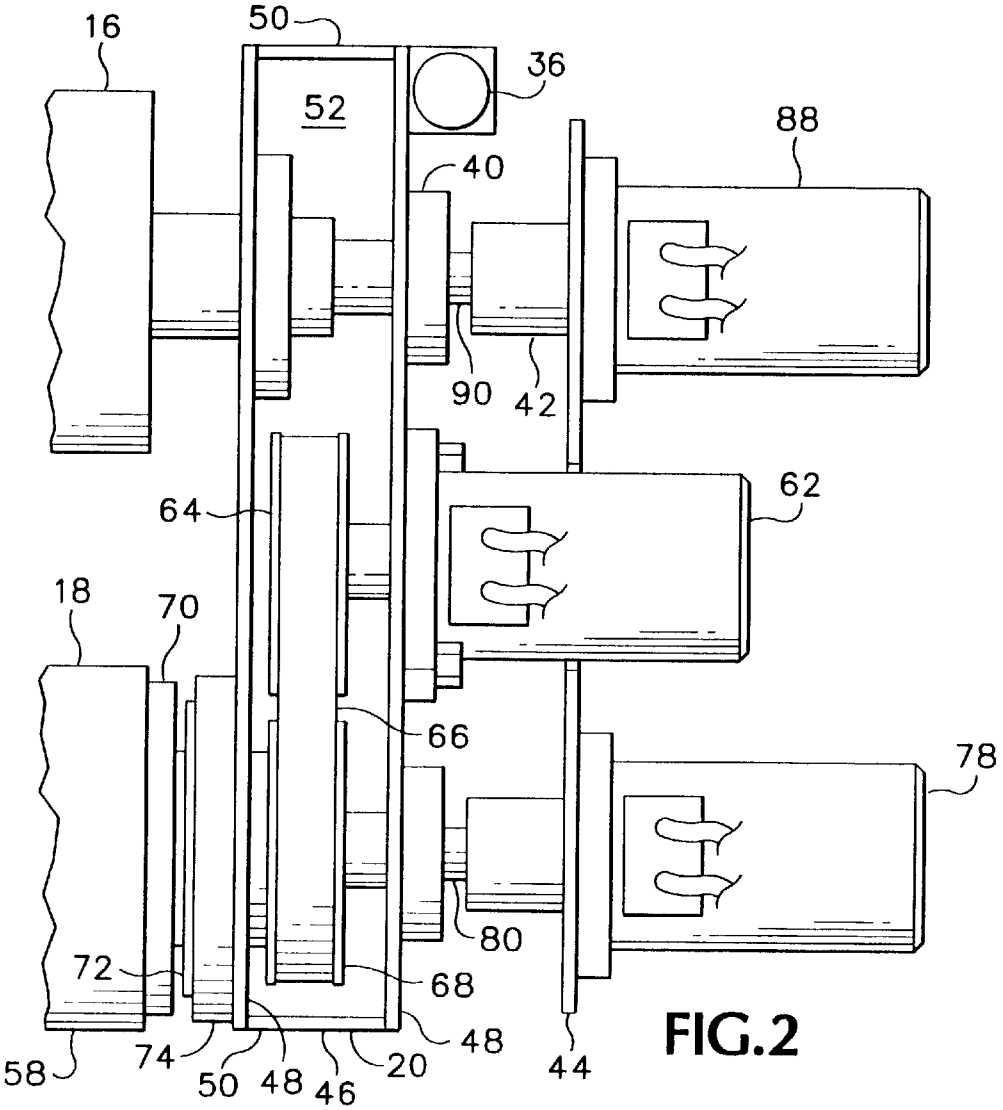
FIG. 2 is a top plan view of a preferred embodiment of a drive end of the roller screed showing the motors and their respective connections to the strike and drive tubes.
Figure 4:
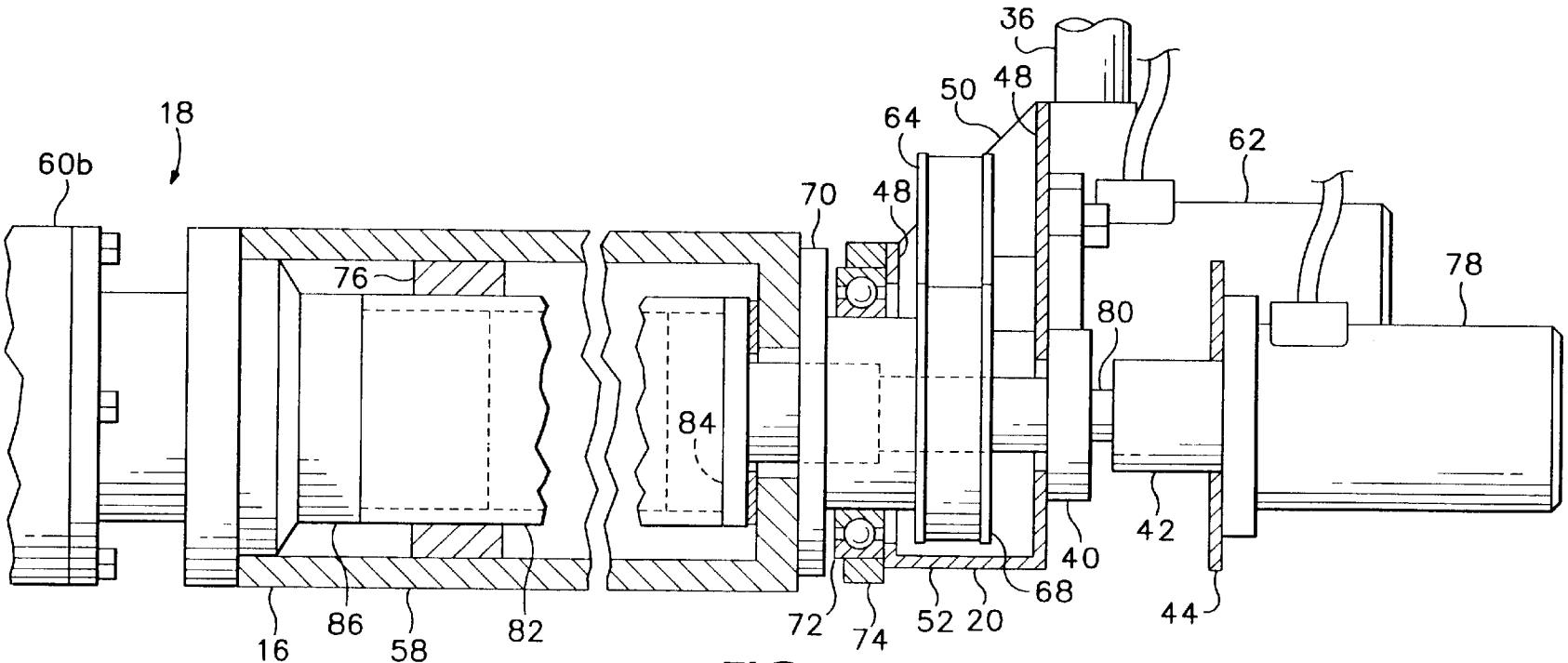
FIG. 4 is a cross-section, side-view elevation of the roller screed drive end of FIG. 2.

As stated, a conventional method of making a concrete pad, or floor, is to pour concrete onto a surface between concrete forms. With respect to FIG. 1, viscous concrete 10 is poured onto a floor, or ground surface, between two spaced-apart, longitudinal forms 12*a* and 12*b* (collectively, forms 12). The concrete is spread so that it covers the floor surface and contacts the forms 12. It is then necessary to screed a top surface of the concrete as an initial finishing step.

A preferred embodiment of a screed 14 of the present embodiment is shown located atop the forms 12 and includes a strike tube 16 and split drive tube 18. The strike tube 16 and drive tube 18 are coupled by end plates: a drive element plate 20 and idler element plate 22. Attached to the drive element plate 20 is a control handle 24 having a control mechanism 26 mounted thereon. Attached to the idler element plate 22 is a second handle 28.

Hydraulic hoses, shown collectively at 30, provide hydraulic pressure from a hydraulic source (not shown) to rotate the strike tube 16 and drive tube 18. The strike tube 16 is the leading-edge of the screed at the point of contact with the concrete as the screed proceeds along the forms 12. The drive tube 18 frictionally engages the forms and is hydraulically powered to move the screed along the forms and is the trailing edge of the screed. In the arrangement of FIG. 1, the screed will travel in the direction indicated by arrow 32.

In general, the control mechanism 26 is operated to control hydraulic power to the strike tube 16 and drive tube 18. Preferably, the rotation speed of the strike tube 16 will be fast relative to the rotation speed of the drive tube 18. In addition, the drive tube and strike tube will rotate in different directions. Thus, the strike tube will be driven to rotate such that a top of the strike tube is moving opposite the direction of travel and a top of the drive tube 16 is moving in the direction of travel 32. Further, in preferred embodiments, the strike tube has a smooth surface and the drive tube has a non-slip surface where the drive tube. rests atop the forms 12. Accordingly, the strike tube 16 slips on the forms 12 and the drive tube frictional engages the forms 12 to drive the screed along the forms.

The relatively high rotational speed of the strike tube, and its reverse rotation direction, provides a finish surface to the concrete 10. Additional finishing of the surface may also be necessary.

Preferably, the control handle 24 is pivotally mounted to the screed 14. In the preferred embodiment, the control handle 24 includes a bushing 34 that is rotatably coupled to a pin 36 that is fixedly attached to the drive element plate 20. The control handle may be rotated outboard of the screed in order to make the screed more maneuverable in tight situations. For example, by rotating the control handle outboard 90 degrees from the orientation shown in FIG. 1 so that the longitudinal handle extension 38 is substantially aligned with the longitudinal direction of the strike tube 16, the strike tube can be driven very close to a vertical wall.

Similarly, the second handle 28 includes a bushing 34 that is rotatably mounted on a pin 36 that is fixedly attached to the idler element plate 22 so that the second handle 28 may be rotated relative to the idler element plate so as to maneuver the screed.

In operation, an operator will grab the control handle 24 and operate the controls on the control mechanism 26. A second worker will grab the second handle 28. Subsequently an operator will use the control mechanism 26 to provide hydraulic power to hydraulic motors 62, 78, and 88, which in turn will rotate the drive tube 18 and the strike tube 16.

Controls are provided to control the direction of rotation, and the speed of rotation, of each tube individually. As stated, preferably, the strike tube 16 is controlled so as to spin at relatively high rotational speed and opposed to the direction of travel. In contrast, the drive tube 18 is operated to propel, or drive, the screed 14 in the direction of travel 32 at a rate of speed approximately equal to a walking pace. Thus, an operator is located at each handle and the controls are operated to spin the strike tube and rotate the drive tube to move the screed so that freshly poured concrete in front of the screed 14 is screeded level with the forms 12. It may be desirable to make additional passes over the concrete to achieve the desired finish.

The screed may be controlled during operation by raising and lowering the handles. When the operators raise the distal end of the handles, the screed pivots about the strike tube and more weight is placed on the drive tube thereby allowing the drive tube to obtain a better grip on the forms and provide more motive force to the screed. Alternatively, pushing down on the distal end of the handles pivots the screed about the strike tube and raises the drive tube off the forms thereby reducing the pressure of the drive tube on the form and the ability of the drive tube to push the screed forward. The operators can fine tune control of the screed by varying degrees of raising and lowering the distal ends of the handles.

The split drive tube 18 of the present invention further assists in controlling the screed during operation and enables operation of the screed by a single operator. Rotatably-coupled, axially-aligned drive tube portions can be independently controlled to control the speed and power applied to each respective drive tube portion. Thus, a drive tube end that encounters more resistance to forward motion can be driven with greater power to overcome a tendency of the screed to become skewed. If the screed becomes skewed, the drive tube portion at the end that is lagging behind can be made to rotate more quickly so as to cause the lagging end to catch up to the advanced end. Conversely, the advanced end may be slowed, or temporarily stopped, to allow the lagging end to catch up.

The Tubes

Preferably, the strike tube 16 and drive tube 18 are similar in dimensional characteristics. Each tube is approximately six inches in diameter and fabricated of a structural metal such as steel or aluminum. Oftentimes it is desirable to have heavy tubes, making steel, or iron, a preferred material. The ends of each tube, and tube portions, are sealed so as to close off an interior of the tubes.

Preferably, the tubes are connected to the plates 20, 22 by thrust bearings 40 that are bolted to the plates 20, 22. Where the tubes connect to a hydraulic motor,, a shaft having a splined portion and a threaded portion (not shown) is provided wherein the splined portion passes through the bearing and plate and connects to a coupler 42, which in turn connects to the hydraulic motor. This method of connection is know in the art and taught in U.S. Pat. No. 5,456,549.

As shown, hydraulic motors 62, 78, and 88 are mounted on a motor plate 44 that is space-apart from the drive element plate 22. This arrangement permits space to make connections between drive and strike tube axles 80, 90, splined shafts, couplers 42, and the motors 78, 88.

In order to prevent misalignment of the tubes relative to the plates 20, 22, and relative to each other, at least one plate, and preferably both plates, are provided as an anti-skew box 46. With reference to the box member 46 of the drive element plate 20, a preferred embodiment of the box member 46 includes plates 48 and flanges 50 arranged as a box-like parallelogram. The box member 46 further includes a bottom plate 52 to provide additional rigidity to the box member 46. Additionally, further plates or cross-members may be provided as desired for additional rigidity.

The anti-skew boxes 46 provide connection of the strike and drive tubes to the plates 48 at two spaced-apart locations that are rigidly connected. Accordingly, the relationship of the plates to the tubes' axles is substantially more rigid than would be a single point connection between the plates and the tubes' axles. Accordingly, the anti-skew box maintains the drive plate 20 at an orientation substantially orthogonal to the strike and drive tubes 16, 18 and assists in maintaining a parallel orientation of the drive tube and strike tube.

The drive tube is split into a first portion 58 and a second portion 60. The portions are cylindrical, axially aligned, and arranged so that each portion is at opposite ends of the screed 14. Thus, each drive tube portion 58, 60 setsatop the opposite sides of the forms 12*b* and 12*a,* respectively as shown in FIG. 1.

The second portion 60 includes first and second cylinders 60*a* and 60*b* that are fixedly coupled together. The cylinder 60*a* is a drive cylinder and preferably includes a non-slip outer surface to assist in gripping the forms 12 to propel the screed. The drive cylinder 60*a* is rotatably coupled to the idler plate 22. Bolted to the drive cylinder 60*a* is the cylinder 60*b* that serves as a spacer cylinder. The spacer cylinder 60*b* has a length that is selected to adjust the overall length of the screed to the form width and so that the combined length of the first and second cylinders 60*a* and 60*b* and the first drive tube portion 58 is substantially equal to a length of the strike tube 16.

The first drive tube portion 58 is also a drive cylinder, similar to the first cylinder 60*a*. In particular, the first drive tube portion includes a non-slip outer surface to grip the forms 12 to assist with propelling the screed.

The first drive tube portion 58 is belt driven by a hydraulic motor 62 that is mounted directly on the drive element plate 20. The first portion motor 62 drives a first belt gear 64 that is coupled to a second belt gear 68 by a belt 66. The second belt gear 68 is fixedly coupled a block 70 that is rotatably mounted to the drive element plate 20 by a ball bearing assembly 72 that is coupled to a circular flange 74 that is welded to the plate 20. The block 70 is fixedly coupled to the first drive tube portion 58 at an end thereof. The first drive tube portion 58 is further supported by a bushing 76 located within the tube.

Accordingly, when hydraulic power is supplied to the motor 62, the motor turns the belt 66 which turns the block 70 and thus turns the first drive tube portion 58. The hydraulic motor 62 may be controlled to drive the first drive tube portion in either a first direction of rotation or a second, opposite, direction of rotation. The hydraulic motor 62 is provided with an adjustment in the form of a arcuate slot 77 cut in the drive element plate 20 to permit the motor to be rotated about mounting bolt 80 to tighten the belt.

The second drive tube portion 60 is driven by a hydraulic motor 78 that is coupled to the motor plate 44. Coupler 42 couples the motor 78 to a shaft 80 that passes through a thrust bearing 40. The shaft continues through, but not contacting, the second belt gear 68 and connects to an inner tube 82, that is located within the first drive tube portion 58, by a block coupler 84. The inner tube 82 proceeds within the first drive tube portion 58 to a stepped block 86 that bolts to spacer cylinder 60*b* of the second drive tube portion 60. The combination of the stepped block 86, inner tube 82, and block coupler 84 rotate freely within the first drive tube portion 58 and ride within bushing 76.

Thus, motor 62 may be operated to rotate the first drive tube portion 58 and the motor 78 may be operated to rotate the second drive tube portion 60. The motors may be arranged so as to operate independently or cooperatively. In independent operation the motors each have separate controls and are independently controlled as desired. In cooperative arrangement, the motors share hydraulic (or electric) power and a single control determines relative power as between the motors to change the relative speed of rotation of the two drive tube portions 58, 60. Other arrangements are within the scope of the invention. A preferred arrangement for operation of the motors is disclosed below.

The strike tube 16 is driven by a hydraulic motor 88 attached to the motor plate 44. A coupler 42 couples the motor 88 to an axle 90 of the strike tube 16. The axle 90 passes through a thrust bearing 40, the drive element plate 20, and couples to the strike tube 16. Preferably, the strike tube 16 is independently operated. In general,the strike tube will run at a constant rate of rotation and is controlled only to stop the strike tube, or reverse direction of rotation.

Drive Mechanism and Power Supply

Figure 5:
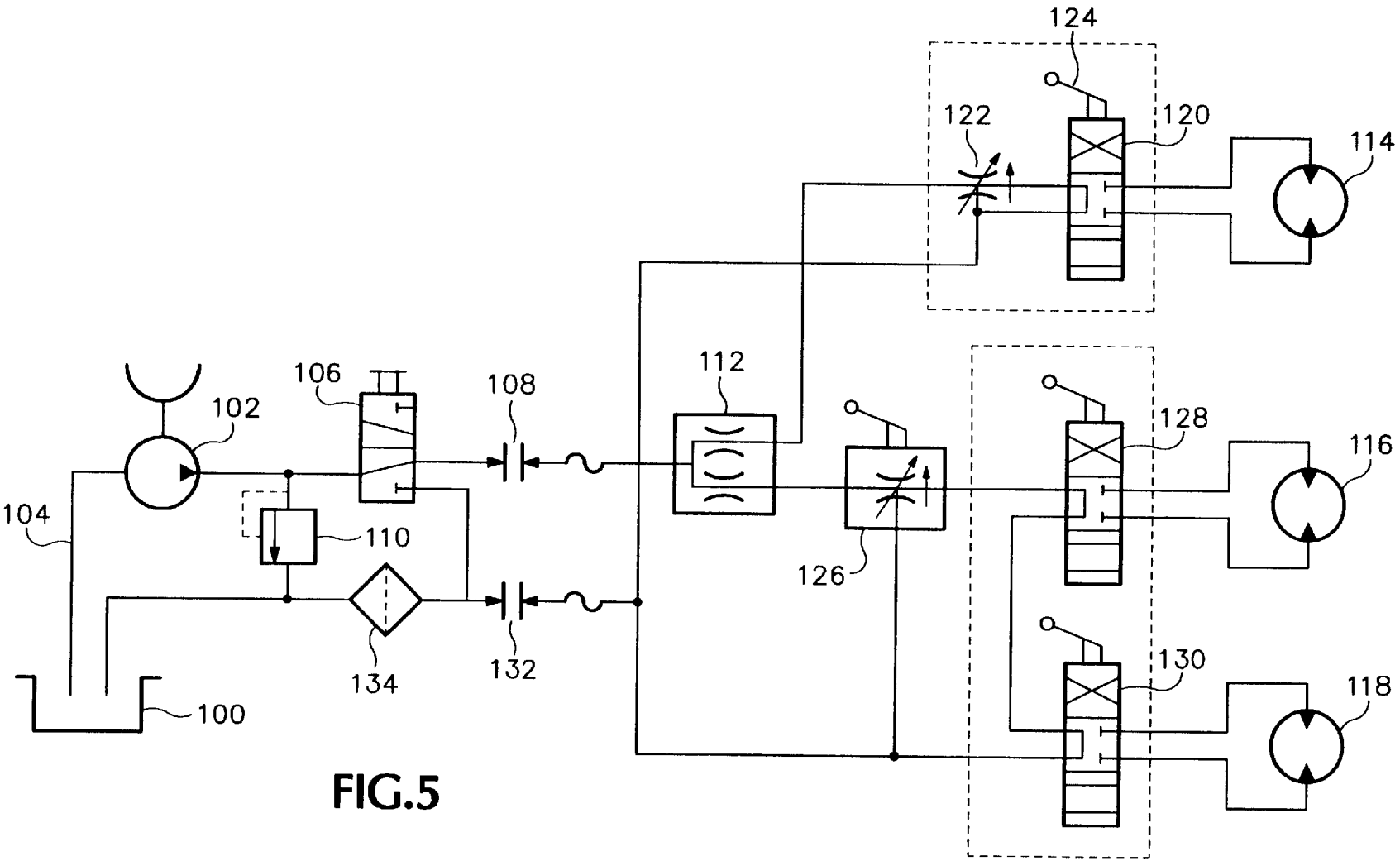
FIG. 5 is a schematic diagram of a preferred embodiment of a hydraulic system for the split drive tube screed of the present invention.

With reference to the schematic diagram of FIG. 5, a preferred embodiment of a hydraulic system for control of the three motors 62, 78, and 88, and hence the tubes 16, 18, is described. A hydraulic oil reservoir 100 provides hydraulic fluid to a pump 102 via hydraulic line 104. From the pump, hydraulic fluid is directed to a selector valve 106 that controls the hydraulic flow to the screed via a disconnect 108. A relief valve 110 is located between the pump 102 and the selector valve 106 to shunt overpressure fluid from the high pressure side of the pump.

At the screed, the hydraulic fluid flow is split at a flow divider 112 into two paths; one to a hydraulic motor 114 that drives the strike tube 16 and one path that flows to hydraulic motors 116 and 118 that drive the split drive tube 18. In preferred embodiments, the divider is set to create a theoretical flow of approximately 7.78 gallons per minute to the strike tube motor 114 and 2.50 gallons per minute to the drive tube motors 116 and 118. These flows are sufficient to rotate the strike tube at a rate up to 400 revolutions per minute and the drive tube at a rate up to 40 revolutions per minute.

The actual flow to the strike tube motor 114 is controlled by a directional control valve 120 that includes a flow control valve, represented at 122. The control valve 120 has three positions for forward rotation, no rotation, and backward rotation. The flow control 122 is internal to the directional control valve 120 and is controlled by the same lever 124 as the directional control valve 120.

The hydraulic flow to the drive tube motors 116 and 118 proceeds from the flow divider 112 to a flow control valve 126 and then to a first directional control valve 128. From the first control valve 128, the hydraulic fluid flows to the first drive tube motor 116, then to a second directional control valve 130, and then to the second drive tube motor 118. The first and second control valves 128,130 each have three positions for driving a respective motor forward or backward, and a neutral position that does not drive the motor. The valves 128, 130 are shown set at the neutral position in FIG. 5. The flow control valve 126 controls the speed of the motors, and hence the rate of rotation of the drive tube portions 58, 60. Because the motors 116, 118 are connected in series, both motors are driven at the same rotational speed. However, each motor may be individually controlled as to its direction of rotation, or placed in neutral.

The flow valves 122, 126 are pressure compensated valves. The hydraulic fluid leaves the screed via disconnect 132, through a filter 134, and to the reservoir 100.

Additional Alternative Embodiments

In the embodiment of FIGS. 1–5, the drive tube 18 includes the first drive tube portion 58 and the second drive tube portion 60 that has the first cylinder 60*a* and the spacer cylinder 60*b*. Alternatively, the second drive tube portion may be a unitary cylinder that extends from the first drive tube portion to the idler plate 22.

In the configurations shown and described above, separate motors 62, 78 control the first and second drive tube portions, respectively. In alternative embodiments, the first and second drive tube portions 58, 60 may be driven by a single motor, and a clutch, or other variable drive mechanism or power transfer device, may be used to permit separate control of power to the respective portions 58, 60.

In the embodiments of FIGS. 1–4, the hydraulic motors 78 and 88 are mounted outboard of the drive element plate 20. Alternatively, the hydraulic motors 62, 78 and 88 may be mounted above ends of the tubes 16, 18 and provide motive power to the tubes by gear, belt, or chain connection to sprockets mounted on the tube axles 80, 90.

In FIG. 1 the control mechanism 26 is generically represented as including four control levers. Alternatively, the control mechanism 26 may take many different forms, such as including dead man switches, or knobs, or other control means.

The hydraulic flow schematic of FIG. 5 provides a preferred embodiment. However, alternative embodiments of routing the hydraulic power to the motors is also within the scope of the invention. The drive tube motors 116, 118 may be arranged in parallel and provided with separate flow control valves so that each drive tube motor may be separately controlled as to rotational speed. Alternatively, one drive tube motor may be used to drive both drive tube portions 58, 60, wherein a clutch, or other variable power transfer device, is used to control the power provided to the respective drive tube portions so as to permit individual control of the drive tube portions.

Summary

This patent specification sets forth a detailed description of a preferred embodiment of the invention as known to the inventor at the time the underlying patent application was filed. Also disclosed are such alternative embodiments, known at the time of filing, that readily occur to the inventors. No attempt is made to describe all possible embodiments, modes of operation, designs, steps or means for making and using the invention.

Where necessary, the specification describes the invention and states certain arrangements of parts, materials, shapes, steps, and means for making and using the invention. However, the invention may be made and used with alternative arrangements, materials, and sizes. Thus, it is intended that the scope of the invention shall only be limited by the language of the claims and the law of the land as pertains to valid patents.

What is claimed is:

1. A screed, comprising:

first and second end plates;

a strike tube rotatably coupled to the first and second end plates and extending substantially therebetween;

a drive tube rotatably coupled to the first and second end plates and extending substantially therebetween, the drive tube including a first drive cylinder, a spacer tube, and a second drive cylinder, a shaft for driving the first drive cylinder extending through and pivotally secured to the second drive cylinder;

a first motor coupled to the first drive cylinder to drive the first drive cylinder;

a second motor coupled to the strike tube to drive the strike tube; and, a third motor coupled to the second drive cylinder to drive the second drive cylinder;

wherein the first drive cylinder is rotatably coupled to the second drive cylinder, such that the first drive cylinder and the second drive cylinder may be independently operated to control movement of the screed and to maintain the screed relative to a desired path.

2. The screed of claim 1, wherein the first drive cylinder is fixedly coupled to the spacer tube.

3. The screed of claim 1, wherein the first drive cylinder, the spacer tube, and the second drive cylinder define a first length and the strike tube has a length that is substantially equal to the first length.

4. A roller screed, comprising:

an elongate strike tube powered by a first power source to rotate about a first axis in a first direction of motion of the roller screed during screeding;

a drive tube having first and second portions powered by at least one second power source, wherein the first and second portions are cylindrical and axially aligned along a second axis, said first and second axes spaced apart and substantially parallel to each other, said strike tube and drive tube operably secured to a frame extending therebetween;

a shaft for driving the first portion extending through and pivotally secured to the second portion along said second axis such that said at least one second power source is operably secured to said shaft toward said second portion for driving said first portion independently from said second portion thereby controlling motive force on the roller screed.

5. The screed of claim 4, wherein the strike tube, the first drive tube portion, and the second drive tube portion are independently operated as to rotation direction and rotation speed.

6. The screed of claimed 4, wherein the strike tube is a unitary tube having a surface that extends along its length without a substantial discontinuity.

7. The screed of claim 4, wherein the second drive tube portion includes a drive cylinder and a spacer cylinder that are fixedly coupled.

8. The screed of claim 7, wherein the drive cylinder of the second drive tube portion, and the first drive tube portion include a non-slip surface.

* * * * *